US011376481B2

(12) United States Patent
Huther et al.

(10) Patent No.: US 11,376,481 B2
(45) Date of Patent: Jul. 5, 2022

(54) PUCK AND METHOD FOR MANUFACTURING A PUCK

(71) Applicant: Fraunhofer-Gesellschaft zur Foerderung der angewandten Forschung e.V., Munich (DE)

(72) Inventors: Mathis Huther, Erlangen (DE); Stefan Wildenhof, Erlangen (DE); Thomas Pellkofer, Erlangen (DE); Reiner Retkowski, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/358,618

(22) Filed: Mar. 19, 2019

(65) Prior Publication Data

US 2019/0209905 A1 Jul. 11, 2019

Related U.S. Application Data

(63) Continuation of application No. PCT/EP2016/072189, filed on Sep. 19, 2016.

(51) Int. Cl.

| | |
|---|---|
| ***A63B 67/14*** | (2006.01) |
| *A63B 102/24* | (2015.01) |
| *A63B 69/00* | (2006.01) |

(52) U.S. Cl.

CPC ..... *A63B 67/14* (2013.01); *A63B 69/0026* (2013.01); *A63B 2102/24* (2015.10); *A63B 2220/10* (2013.01)

(58) Field of Classification Search

CPC .. A63B 67/14; A63B 69/0026; A63B 2102/24

USPC ..... 473/588

See application file for complete search history.

(56) References Cited

U.S. PATENT DOCUMENTS

| | | | | |
|---|---|---|---|---|
| 4,078,801 | A | 3/1978 | White, Sr. | |
| 4,183,536 | A | 1/1980 | Platt | |
| 4,968,036 | A * | 11/1990 | Von Der Mark ..... | A63B 67/14 473/570 |
| 5,014,990 | A | 5/1991 | Kaser et al. | |

(Continued)

FOREIGN PATENT DOCUMENTS

| | | |
|---|---|---|
| CN | 2108652 U | 7/1992 |
| CN | 2223638 Y | 4/1996 |

(Continued)

OTHER PUBLICATIONS

"Tracking the Ice Hockey Puck—FoxTrax (Glow Puck)", http://ethw.org/Tracking_the_Ice_Hockey_Puck_-_FoxTrax_(Glow_Puck) (accessed Mar. 6, 2019), 1-3.

*Primary Examiner* — Laura Davison

(74) *Attorney, Agent, or Firm* — Perkins Coie LLP; Michael A. Glenn

(57) ABSTRACT

A puck having an outer shell formed using a cylindrical body and a circular cover. The cylindrical cover exhibits a first groove and tongue structure formed in an axial end surface of the cylindrical body, which surrounds a cavity formed in the cylindrical body. The circular cover includes a second groove and tongue structure formed in a surface of the circular cover and fitting to the first groove and tongue structure. The circular cover is attached to the cylindrical body using the first and the second groove and tongue structure.

12 Claims, 4 Drawing Sheets

(56) References Cited

U.S. PATENT DOCUMENTS

| | | | | |
|---|---|---|---|---|
| 5,184,820 | A | 2/1993 | Keating et al. | |
| 5,207,720 | A | 5/1993 | Shepherd | |
| 5,269,520 | A | 12/1993 | Vellines | |
| 5,284,343 | A | 2/1994 | Bigornia et al. | |
| 5,288,072 | A | 2/1994 | Hsieh | |
| 5,348,298 | A | 9/1994 | Montgomery | |
| 5,564,698 | A | 10/1996 | Honey et al. | |
| 6,146,293 | A * | 11/2000 | Chinn | A63B 67/14 473/588 |
| 8,727,918 | B1 * | 5/2014 | Gentile | A63B 43/06 473/570 |
| 9,511,268 | B1 * | 12/2016 | Levy | A63B 60/24 |
| 10,016,669 | B2 * | 7/2018 | Mason | A63B 67/14 |
| 10,112,095 | B2 * | 10/2018 | Serowik | A63B 67/14 |
| 2003/0084695 | A1 | 5/2003 | Stark et al. | |
| 2003/0119613 | A1 | 6/2003 | Samuel et al. | |
| 2004/0188882 | A1 | 9/2004 | Matsumoto et al. | |
| 2006/0205545 | A1 | 9/2006 | Coleman et al. | |
| 2015/0375076 | A1 * | 12/2015 | Mayer, II | A63B 67/14 473/588 |
| 2017/0232307 | A1 | 8/2017 | Weilong | |

FOREIGN PATENT DOCUMENTS

| | | | |
|---|---|---|---|
| CN | 2468528 | Y | 1/2002 |
| CN | 201235185 | Y | 5/2009 |
| CN | 103585745 | A | 2/2014 |
| CN | 104540558 | A | 4/2015 |
| CN | 105561554 | A | 5/2016 |
| CN | 205379617 | U | 7/2016 |
| EP | 2527013 | A1 | 11/2012 |
| JP | 5565069 | B2 | 6/2014 |
| JP | 6266681 | B2 | 1/2018 |
| RU | 97645 | U1 | 9/2010 |
| SU | 1718993 | | 3/1992 |
| WO | 9320910 | A1 | 10/1993 |
| WO | 9524949 | A1 | 9/1995 |
| WO | 2013181551 | A2 | 12/2013 |

* cited by examiner

PUCK AND METHOD FOR MANUFACTURING A PUCK

CROSS-REFERENCES TO RELATED APPLICATIONS

This application is a continuation of copending International Application No. PCT/EP2016/072189, filed Sep. 19, 2016, which is incorporated herein by reference in its entirety.

The present invention relates to a puck and a method for manufacturing same.

BACKGROUND OF THE INVENTION

Generally, a puck is a cylindrical gaming device (disk) that serves the same functions in various games as a ball does in ball games. Examples of such games are ice hockey and roller hockey. The term "puck" may also be applied to similar (though often smaller) gaming discs in other sports and games, including novuss, shuffleboard, table shuffleboard, box hockey and air hockey. Generally, a puck may be made of vulcanized rubber or plastic.

A puck, which is quite small and travels at extremely high speeds, can be almost impossible to follow, even by the most attentive spectators. Thus, there have been attempts to integrate electronics into a puck to make the puck visible using microwave- and infrared-based tracking systems. As shown on this website, an off-the-shelf ice hockey puck is separated in the middle of its cylindrical mantel, i.e. on half height of the cylinder, resulting in two equally sized parts. Subsequently, a cavity was formed for a to-be-inserted object (such as an electronic circuit with infrared light emitting diodes) by hollowing out the two parts. Additionally, the two parts exhibit recesses along the circumference to enable fitting with light emitting diodes. After loading with the electronic circuit, both halves are being assembled supposedly by adherence. Due to the tolerances in the manufacturing and mechanical postprocessing of the puck the two halves most probably do not have a common outer surface line and therefore generally, a good and seamless fit cannot be guaranteed.

In US 2015/0375076 A1 a puck is disclosed suitable to be fitted with a ballast member to enhance the ability to slide on ice and non-ice surfaces.

In U.S. Pat. No. 5,269,520 A, a multi-layered puck is disclosed for use on paved surfaces.

In U.S. Pat. No. 5,207,720 A, a puck is disclosed configured to indicate an energy acting on the puck when being struck.

U.S. Pat. No. 5,184,820 A discloses a puck with at least three symmetrically spaced projections which may have a lower coefficient of friction than the body of the puck.

In U.S. Pat. No. 4,078,801 A, a puck is disclosed for playing an ice hockey-like game on untraditional surfaces.

In U.S. Pat. No. 5,564,698 A, a puck is disclosed configured to emit some electromagnetic radiation to enable localization of the puck.

For integration of arbitrary products, such as electronics, into a cylindrical gaming device (movendi), for example a puck, aside of a concentrically fitting of a cover to a base body high mechanical stress acting on the movendum plays a decisive role. The described modularly manufactured pucks suffer due to the modularity from low robustness of their assembly and a non-cost efficient complex manufacturing process.

Therefore, a desire exists for a modularly manufactured puck offering a higher robustness and a more cost efficient production.

SUMMARY

According to an embodiment, a puck may have: an outer shell formed using a cylindrical body and a circular cover, a first groove and tongue structure formed in an axial end surface of the cylindrical body, which surrounds a cavity formed in the cylindrical body, the cavity extending through the center axis of the cylindrical body; a second groove and tongue structure formed in a surface of the circular cover and fitting to the first groove and tongue structure, wherein the circular cover is attached to the cylindrical body using the first and second groove and tongue structures, wherein the thickness of all parts of the circular cover located radially inside the groove and tongue structures is larger than the thickness of the part of the circular cover located radially outside of the groove and tongue structures.

According to another embodiment, a method for manufacturing a puck having an outer shell formed using a cylindrical body and a circular cover may have the steps of: providing the cylindrical body with a first groove and tongue structure on an axial end surface of the cylindrical body, which surrounds a cavity formed in the cylindrical body, the cavity extending through the center axis of the cylindrical body, and providing the circular cover with a second groove and tongue structure on a surface of the circular cover and fitting to the first groove and tongue structure, attaching to each other the cylindrical body and the circular cover using the first and second groove and tongue structure, wherein the thickness of all parts of the circular cover located radially inside the groove and tongue structures is larger than the thickness of the part of the circular cover located radially outside of the groove and tongue structures.

Embodiments provide a puck, such as a hockey puck. The puck comprises an outer shell formed using a cylindrical body and a circular cover. Furthermore, the puck comprises a first groove and tongue structure formed in an axial end surface of the cylindrical body, which surrounds a cavity formed in the cylindrical body. Moreover, the puck comprises a second groove and tongue structure formed on the surface of the circular cover and fitting to the first groove and tongue structure. Additionally, the circular cover is attached to the cylindrical body using the first and second groove and tongue structures.

The described puck can be beneficial due to the modularity of its outer shell, as components may be arranged inside the puck and as separately manufacturing of the cylindrical body and the circular cover can lead to reduced manufacturing costs. Moreover, the described attachment of the cylindrical body to the circular cover by means of the first and the second groove and tongue structure may provide a robust hockey puck. The puck may be robust against high mechanical stress and the provided robustness is crucial for deployment of the puck in the game the puck is intended for, such as an ice hockey game. The cylindrical body and the circular cover may be suitable for mass production and can thereby be used for cost efficient production of the puck.

According to embodiments, the cylindrical body and the circular cover are attached to each other by vulcanization. Attachment of the circular cover and the cylindrical body by vulcanization is especially suitable to increase the robustness of the puck. The described puck can be visually indistinguishable from a non-modularly manufactured puck.

According to embodiments, the cylindrical body comprises the cavity configured to hold an insert. Such embodiments may be advantageous as the same enables loading of the puck with an insert. For example, the insert could be an electronic device simplifying localization of the puck. Localization of the puck can be useful, for example, for spectators watching an ice hockey game.

According to embodiments, the cavity is configured to preserve a center of gravity of the puck when the cavity of the cylindrical body of the puck is loaded with the insert. Preserving the center of gravity may be crucial for acceptance of the puck by players.

According to embodiments, diameters of the circular cover and of the cylindrical body correspond to a total diameter of the puck. Thereby, a more robust puck may be achievable, as protruding edges may be avoided by the coinciding diameters.

According to embodiments, the groove and tongue structures comprise at least a tongue having a rounded edge. Thus fitting or attachment of the circular cover to the cylindrical body may be simplified.

According to embodiments, the outer shell is configured to provide a joint of the cylindrical body and the circular cover on a rough surface of the puck or on a border of a smooth surface and a rough surface of the puck. Having a joint in the described way is suitable for hiding a modular construction of the puck. Furthermore, the hidden joint is less prone to strain applied from the outside, increasing the durability of the puck.

According to embodiments, the groove and tongue structures comprise annular continuous groove and tongue structures. Having a continuous annular groove and tongue structure can be beneficial to increase robustness of the puck. The increased robustness may be achieved due to the increased surface area involved in the attachment provided by the continuous structure all around the axial end surface of the cylindrical body.

According to embodiments, the outer shell may be formed using the cylindrical body, the circular cover, and a second circular cover. A third groove and tongue structure may be formed in a second axial end surface of the cylindrical body, which surrounds the cavity or another cavity formed in the cylindrical body. Additionally, the second circular cover may comprise a fourth groove and tongue structure formed in a surface of the second circular cover and fitting to the third groove and tongue structure. Moreover, the second circular cover may be attached to the cylindrical body using the third and fourth groove and tongue structures. Such embodiments are beneficial as they allow a fully modular manufacturing of the puck. The modularity can be useful to enable a cost efficient production of the puck.

Furthermore, when loading the puck with an insert with a complex geometry, having access to a cavity from both ends of the circular body may simplify loading the puck with the insert.

Embodiments provide for a method for manufacturing a puck comprising an outer shell formed using a cylindrical body and circular cover. The method comprises: providing the cylindrical body with a first groove and tongue structure on an axial end surface of the cylindrical body, which surrounds a cavity in the cylindrical body, providing the circular cover with a second groove and tongue structure on a surface of the circular cover and fitting to the first groove and tongue structure, attaching to each other the cylindrical body and the circular cover using the first and second groove and tongue structure. The described method for manufacturing a hockey puck is especially beneficial due to its low complexity which in turn enables a cost efficient production of robust hockey pucks.

According to embodiments, the method comprises attaching the cylindrical body and the circular cover by vulcanization. Attachment of the cylindrical body and the circular cover by vulcanization bonding improves durability and robustness of the produced puck.

According to embodiments, the method comprises molding of the cylindrical body and the circular cover, for example injection molding. Molding the components may be beneficial since the components may be produced with accurate dimensions. In particular, the groove and tongue structures may be produced accurately and a precise fitting may increase robustness. Furthermore, by using a molding process cost efficiency of the production can be ensured.

According to embodiments, the method comprises putting an insert inside a cavity of the cylindrical body prior to attaching the cylindrical body and the circular body. Putting an insert into the cylindrical body enables creation of pucks with flexible content, e.g. loading with an electronic device.

According to embodiments, the method further comprises: providing the cylindrical body with a third groove and tongue structure formed in a second axial end surface thereof, which surrounds the previously mentioned cavity or another cavity in the cylindrical body; providing a second circular cover comprising a fourth groove and tongue structure formed in a surface thereof and fitting to the third groove and tongue structure; and attaching to each other the cylindrical body and the second circular cover using the third and fourth groove and tongue structures. The method allows for a fully modular assembly of pucks and therefore offers, for example, flexibility in loading the puck with an insert.

Embodiments enable a seamless integration of arbitrary products into a cylindrical gaming device generally called puck.

BRIEF DESCRIPTION OF THE DRAWINGS

Embodiments of the present invention will be detailed subsequently referring to the appended drawings, in which.

DETAILED DESCRIPTION OF THE INVENTION

In embodiments, the puck may be a hockey puck. In embodiments, the puck may be an ice hockey puck, a roller hockey puck, a box hockey puck or an air hockey puck. In other embodiments, the puck may be configured for other games, such as novuss, shuffleboard or table shuffleboard.

Figure 1:
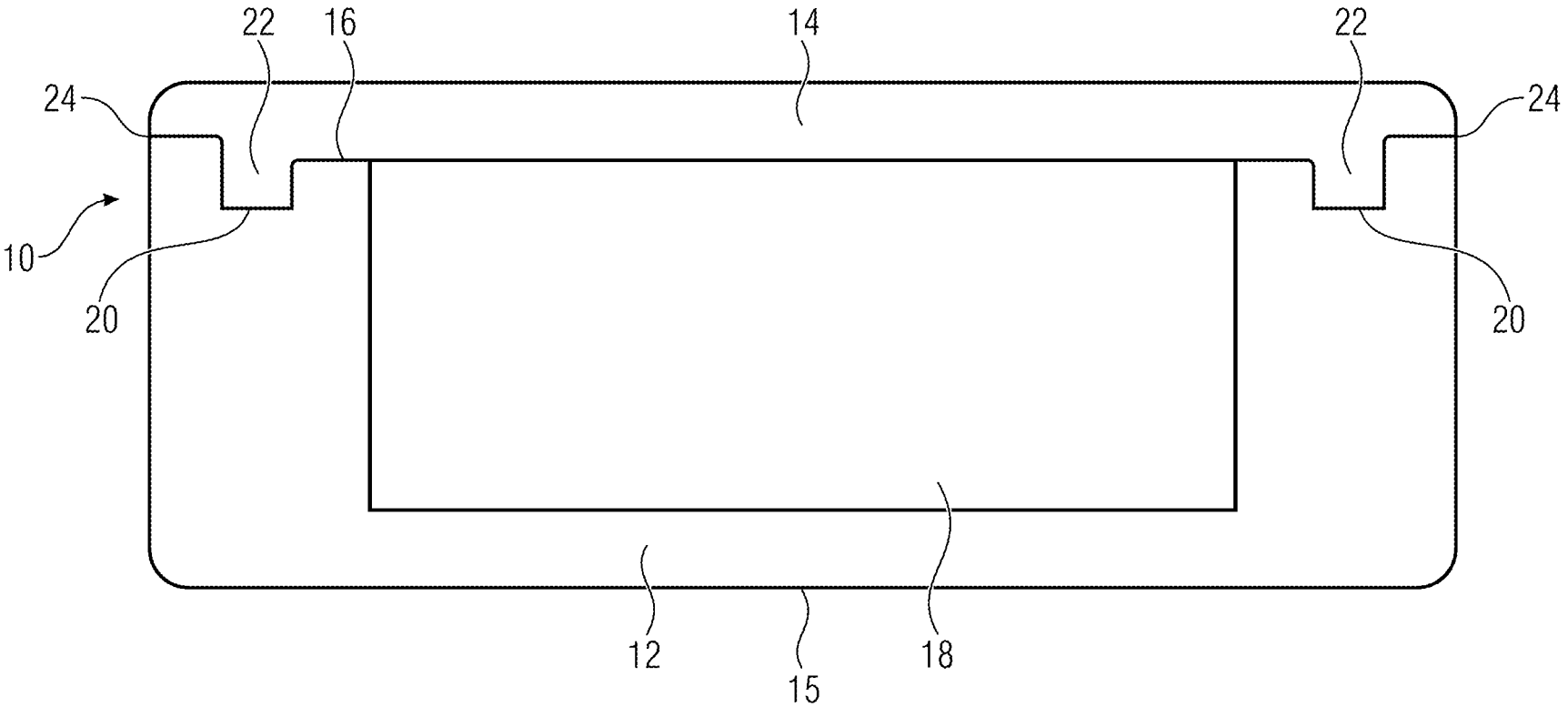
FIG. 1 shows a schematic cross-sectional view of an embodiment of a hockey puck.
Figure 2B:
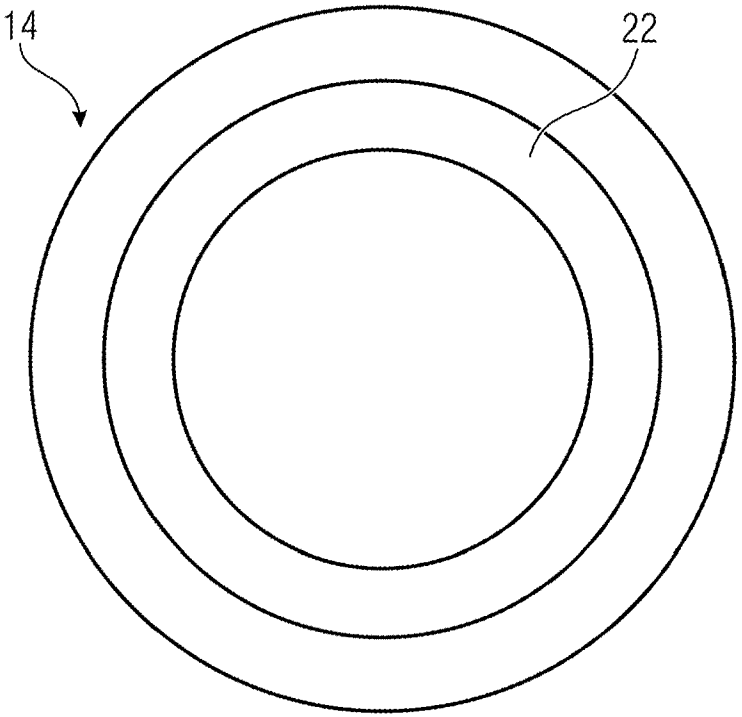
FIG. 2A-C show schematic views of the cylindrical cover of the puck shown in FIG. 1.
Figure 2C:
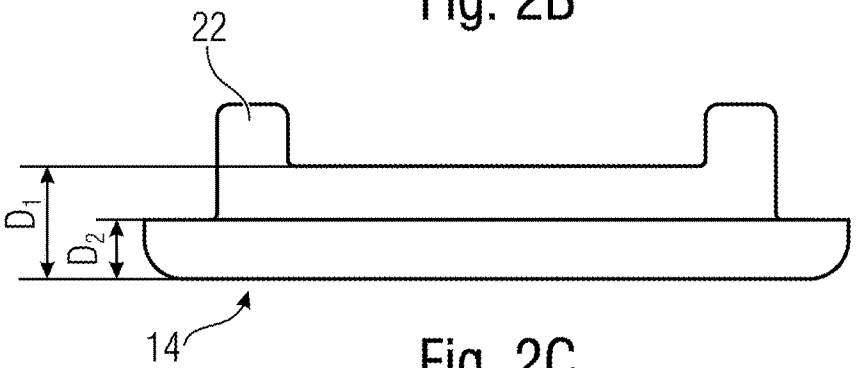
Figure 2A:
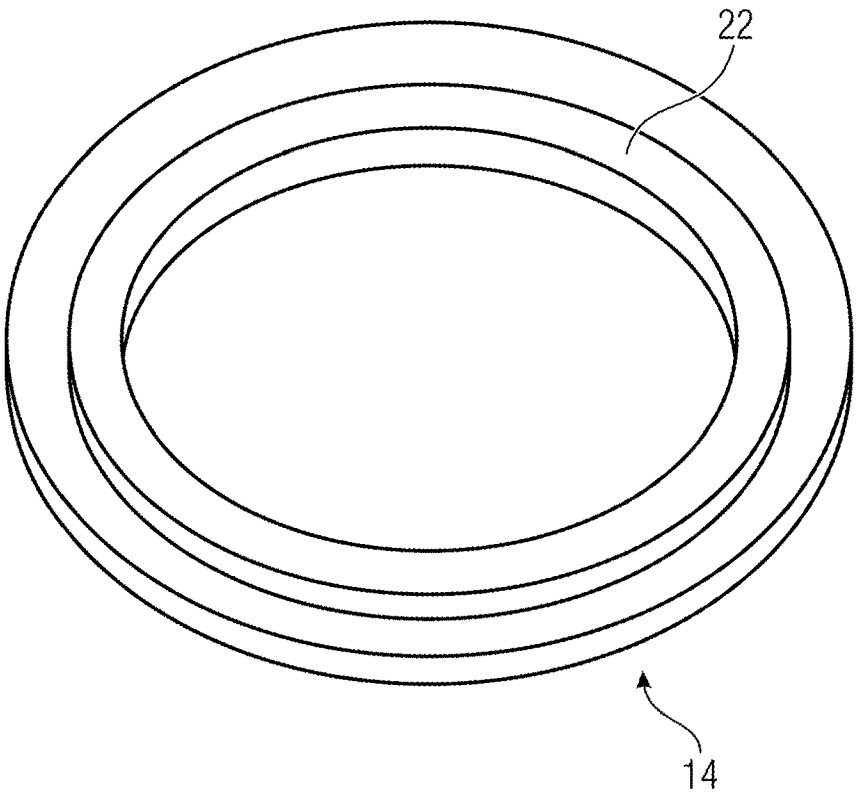

FIG. 1 shows a schematic cross-sectional view of a hockey puck according to an embodiment of the invention. The hockey puck comprises an outer shell 10 formed using a cylindrical body 12 (base body) and a circular cover 14. FIG. 2A shows a perspective view of the circular cover 14, FIG. 2B shows a bottom view (relative to the orientation of the puck shown in FIG. 1) of the circular cover 14, and FIG.

Figure 3:
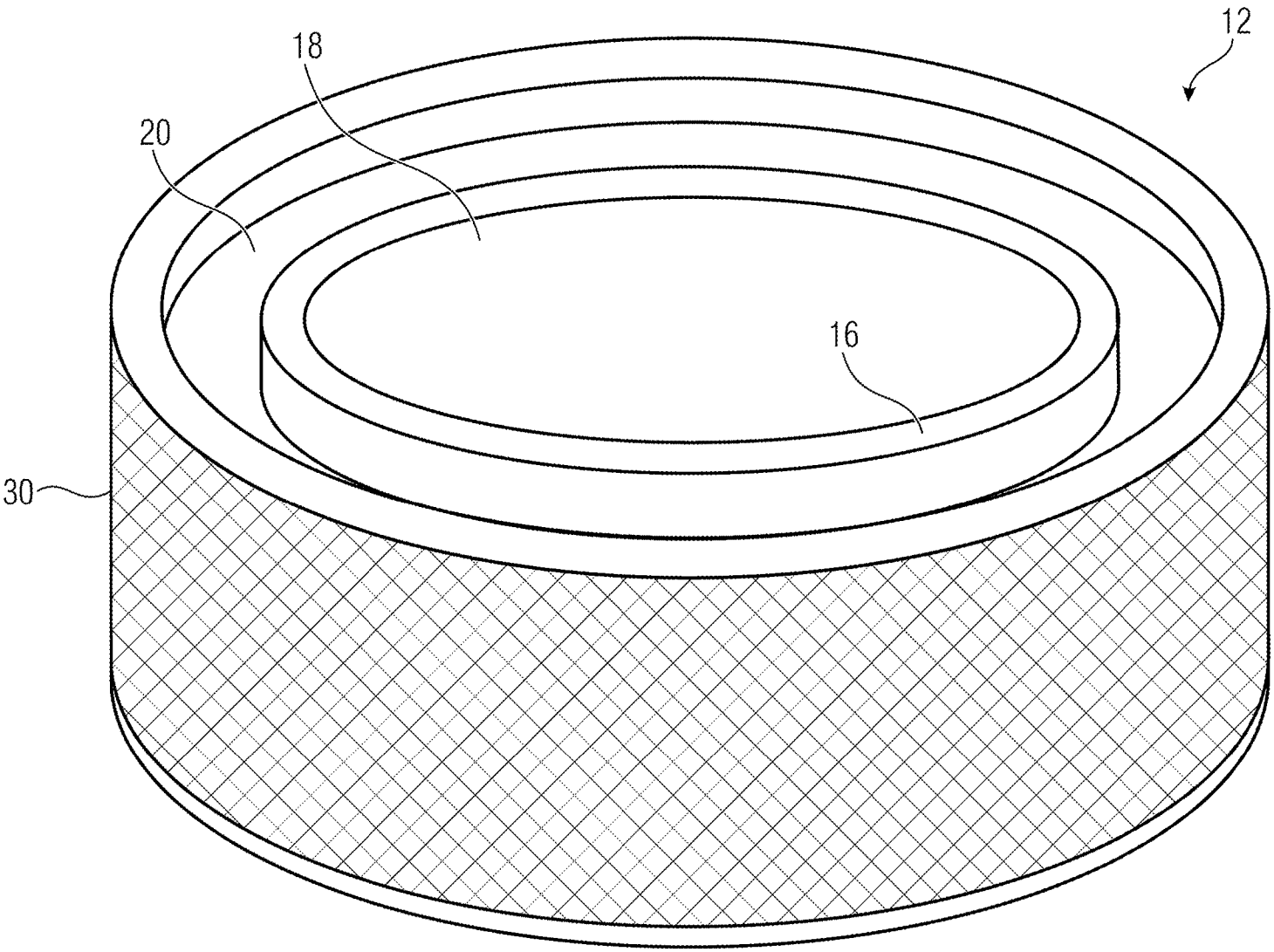
FIG. 3 shows a schematic view of the cylindrical body of the puck shown in FIG. 1.

2C shows a side view of the circular cover 14. FIG. 3 shows a perspective view of the cylindrical body 12.

The cylindrical body 12 is a hollow cylindrical body and comprises a circular end surface 15 and an annular end surface 16. The annular end surface 16 surrounds a cavity 18 of the cylindrical body 12. The cavity 18 is closed at one end (the lower end) of the cylindrical body 12. An annular groove 20 is formed in the annular end surface 16. The groove 20 represents a first groove and tongue structure. The circular cover 14 comprises an annular tongue 22 representing a second groove and tongue structure. The first and second groove and tongue structures fit to each other in that the shapes and dimensions thereof are adapted to each other.

The cylindrical body 12 and the circular cover 14 are attached to each other using groove 20 and tongue 22. Thus, cavity 18 is closed by circular cover 14. To this end, tongue 22 is inserted into groove 20 and engages groove 20. The dimensions of tongue 22 may be slightly larger than the dimensions of groove 20 to obtain at least a medium fit.

In embodiments, vulcanization may be used to attach the cylindrical body 12 and the circular cover 14 to each other. Alternatively or in addition, an adhesive may be used to additionally attach the cylindrical body 12 to the circular cover 14.

Thus, the cylindrical body 12 and the circular cover 14 are attached to each other at a joint 24. The area in which the cylindrical body 12 and the circular cover 14 are attached to each other is increased by the groove and tongue structure when compared to a case in which the groove and tongue structures are not provided. The precise alignment of cover 14 and base body 12 and the enlarged area used for adhesion leads to a more robust joint able to better resist acting forces.

The outer diameter of the cylindrical body 12 may correspond to the diameter of the circular cover 14. Thus, a substantially smooth outer cylindrical surface is obtained upon attaching the cylindrical body 12 to the circular cover 14. As shown in FIG. 2C, the thickness $D_1$ (in the axial direction) of the part of the circular cover 14 located radially inside of tongue 22 may be larger than the thickness $D_2$ of the part of the circular cover located radially outside of the tongue. The shape of the end surface 16 of the cylindrical body 12 is adapted accordingly. To be more specific, the distance between the circular end surface 15 and the part of the end surface 16 located radially inside of groove 20 is less than the distance between the circular end surface 15 and the part of the end surface 16 located radially outside of groove 20. The increased thickness in the central portion of the circular cover 14 may beneficial to increase a stability of the outer shell 10 of the puck.

An insert (not shown) may be loaded into cavity 18 before the cylindrical body 12 and the circular cover 14 are attached to each other. The insert may be, for example, an electronic device useful for locating the hockey puck. The insert may also be a weight which can be useful to improve the physical properties of the hockey puck when playing hockey with it.

Accordingly, on the inside of the cover 14 a continuously annular tongue 22 is located which is fitted to a groove 20 of a base body 12. In this manner, cover 14 and base body 12 can be attached and aligned to each other accurately, so that none of the two parts is protruding on any point of joint 24. This enables a higher durability so that the adhesion can better resist strain acting from the outside. To simplify engagement of the cover 14 and the base body 12, the edges of the tongue 22 may be rounded off, as it is indicated in FIG. 2C.

The groove 20 and the cavity 18 are located on the side of the cylindrical body 12 facing the cover 14. The cavity 18 may be loaded with an insert and the shape of the cavity may be adapted to the shape of the insert. For example, the cavity 18 may be cylindrical or may be star-shaped in a plan view. The shape of the axial end surface surrounding the cavity depends on the shape of the cavity in a plan view. If the cavity is circular in a plan view, the end surface will be completely annular. In either case, the axial end surface surrounds the cavity like a frame and, therefore, may be regarded as being frame-shaped.

Furthermore, the position of the cavity 18 may be adjusted to the insert, for example an electronic device, so that the center of gravity of the puck is not altered despite of loading with the insert. The puck may comprise several layers with differing densities (base material of the puck, circuit board, battery, etc.). In order to achieve playability, which is for example identical to an conventional puck, the center of gravity of the puck can be located in the center of the cylindrical body of the puck, if not the puck may fall on one side or is played from one side (see "jam sandwich principle"). When the insert is symmetrically assembled (e.g. a circular circuit board located in between two button cells), the physical center of gravity lies in the geometric center of the insert. Therefore, in this case the density distribution of the outer shell can be symmetric, to make the physical center of gravity coincide with the geometric center, as it is the case with conventional pucks. This can be achieved by an identical material thickness in radial direction (coaxial alignment of cavity 18) and in axial direction (central alignment of cavity 18), which leads to an identical material thickness above (i.e. in the center of cover 14) and below (i.e. in the center of base body 12) cavity 18.

Figure 4:
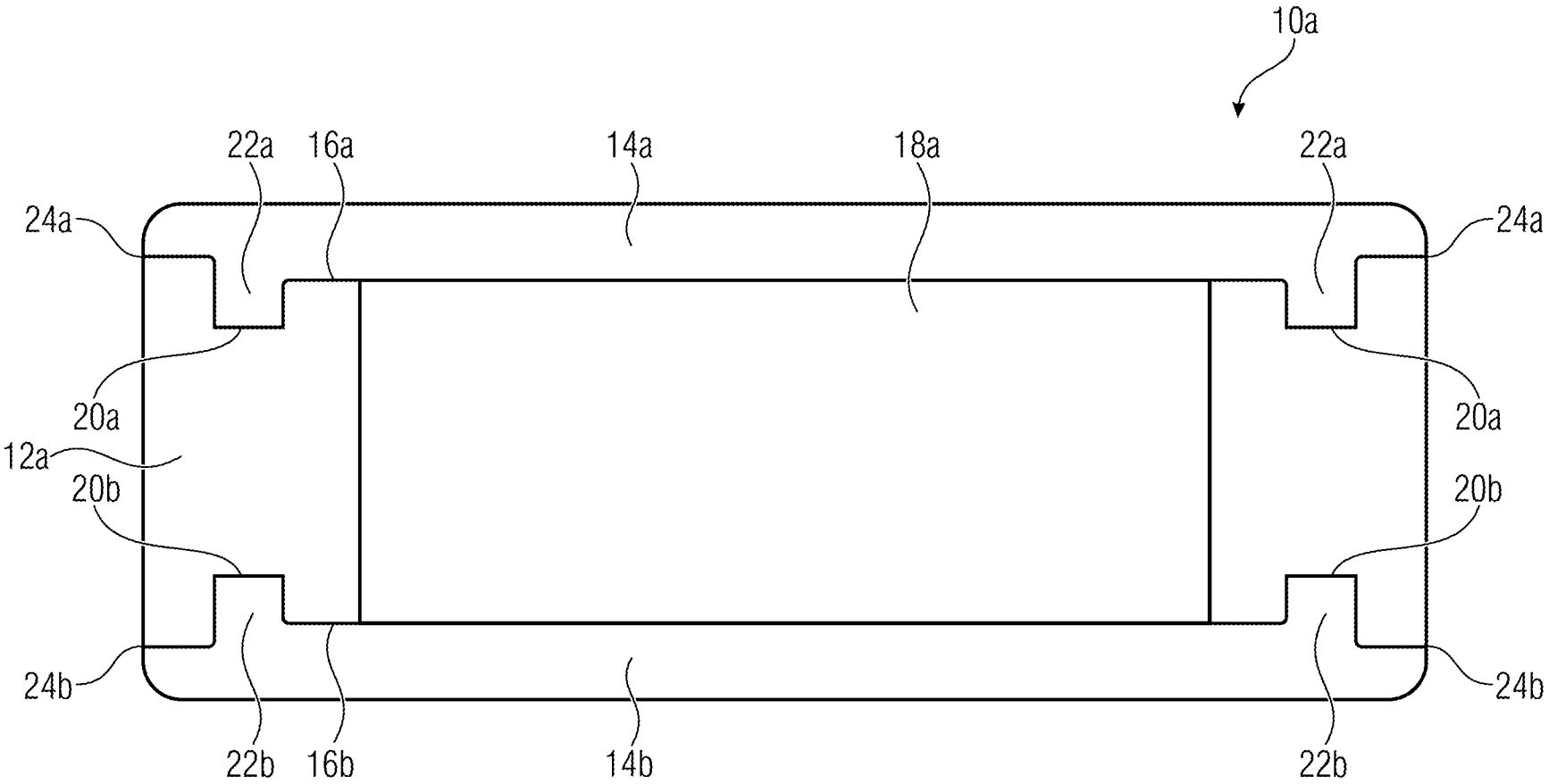
FIG. 4 shows a schematic cross-sectional view of a hockey puck according to another embodiment.

FIG. 4 shows a schematic cross-sectional view of a hockey puck according to another embodiment of the invention. The hockey puck shown in FIG. 4 comprises an outer shell 10*a*. The outer shell 10*a* is formed using a cylindrical body 12*a*, a first circular cover 14*a* and a second circular cover 14*b*. The cylindrical body 12*a* comprises a cavity 18*a*, which is open at both ends of the cylindrical body 12*a*. Thus, the cylindrical body 12*a* is ring-shaped and has two annular end surfaces 16*a* and 16*b*. A first annular groove 20*a* is formed in the first annular end surface 16*a* and a second annular groove 20*b* is formed in the second annular end surface 16*b*. The circular cover 14*a* comprises a first tongue 22*a*, and the second circular cover 14*b* comprises a second tongue 22*b*. The first circular cover 14*a* is attached to the cylindrical body 12*a* using the first groove 20*a* and the first tongue 22*a*. The second circular cover 14*b* is attached to the cylindrical body 12*a* using the second groove 20*b* and the second tongue 22*b*. Thus, the puck comprises two joints 24*a* and 24*b*.

Thus, when compared to the embodiment shown in FIGS. 1 to 3, the embodiment shown in FIG. 4 comprises a cylindrical body with two open ends and two covers. For the rest, the explanations given herein with respect to the embodiment shown in FIGS. 1 to 3 also apply for the embodiment shown in FIG. 4 and need not be repeated.

In embodiments, the single cavity 18*a* shown in FIG. 4 may be replaced by two cavities separated from each other, wherein a first one is covered by cover 14*a* and a second one is covered by cover 14*b*.

Generally, portions of an outer cylindrical surface of a puck may be rough or patterned surface portions. In embodiments, the cylindrical body may comprise a rough or patterned outer surface portion 30, see FIG. 3. A rough surface may be useful for increasing friction when playing hockey with the puck. In embodiments, the joints between the respective cover and the cylindrical body may be arranged so that they are substantially invisible. To this end, the joints may be placed on a border between a rough surface and a smooth surface of the puck. Alternatively, the joints may be placed within the rough surface and at least portions of an outer cylindrical surface of the cover may be rough as well.

In embodiments, the groove and tongue structures are continuous annular groove and tongue structures which are beneficial since the surface used for attaching the respective cover to the circular body may be maximized due to the continuity.

In embodiments, the components of the outer shell of the puck may be formed of a material suitable for vulcanization, such as rubber or polymer. In embodiments, the components of the outer shell of the puck may be formed of plastic.

Generally, the cylindrical body and the circular cover may be arranged coaxial. As used herein, the term axial relates to the longitudinal center axis of the cylindrical body.

In the embodiments described referring to the Figures, the cover comprises a tongue and the cylindrical body comprises a groove. In other embodiments, in which the cover has a larger thickness, the cover may comprise a groove and the cylindrical body may comprise a tongue. Alternatively the cover may comprise a tongue and a groove and the cylindrical body may comprise a tongue and a groove. In embodiments, several tongues and grooves, such as several coaxial tongues and grooves, may be formed in the cover and/or cylindrical body. In embodiments, the groove and tongue structures may be provided in the shape of intermittent tongues and grooves. The term "groove and tongue structure" as used herein is intended to cover such cases.

In embodiments, the joint may be shifted to another position when compared to the described position. For example, thicker covers could be used so that the joint is moved more toward the center in the axial direction. In addition, asymmetrical groove and tongue structures could be used.

Embodiments relate to an approach for implementing hockey pucks, which is fundamentally different from other approaches and may enable potential future mass production. The approach may comprise a separate production of the cover and the base body, for which an injection molding process may be chosen. The injection molding process offers a narrow tolerance range in terms of accuracy and thereby enables an exact fitting of cover and base body.

A diameter of the cover and the base body may correspond to a total diameter of the puck. In addition, the cover and the base body may be arranged coaxially. A joint between these two parts may therefore be located on the cylindrical outer surface (mantel) of the puck and can be arranged, so that it coincides with an edge of a corrugated, or rough, surface, which may comprise an elevated labeling, and a smooth surface, which may comprise a planar imprint. Thereby, it can be ensured that the joint is not visible from the outside.

The cover and a base body are attached to each other by means of groove and tongue structures. On the inside of the cover for example a continuously annular tongue is located which is fitted to a groove of a base body. In this manner, cover and base body can be attached and aligned to each other accurately, so that none of the two parts is protruding on any point of the joint. This enables a higher durability so that the adhesion can better resist strain acting from the outside. To simplify the fitting of the cover and the base body, the edges of the tongue may be rounded off.

Embodiments provide movendum pucks fitted with a technical product, which are indistinguishable from conventional pucks, neither optical (invisible joints) nor from its playing characteristic (identical center of gravity). This leads to an improved acceptance of the players for intelligent playing devices.

According to a further aspect, an approach enables large scale production for loading arbitrary products into cylindrical playing devices, wherein the outer shell of the movendum comprises several individual parts which are produced in a more accurate production process than off-the-shelf playing devices. The tedious detour of mechanical post processing of standard products thereby becomes obsolete.

According to a further aspect, the precise alignment of cover and base body and the strongly enlarged area used for adhesion leads to a more robust joint able to better resist acting forces.

According to a further aspect, the joints between the circular cover and the cylindrical body can be located on an arbitrary location on the puck.

Although some aspects have been described in the context of an apparatus, it is clear that these aspects also represent a description of the corresponding manufacturing method. Thus, description of the respective features in connection with an apparatus is to be regarded as a description of corresponding features of a manufacturing method and such a description was not repeated in this specification.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A puck, comprising:

an outer shell formed using a cylindrical body and a circular cover, wherein a side wall of the cylindrical body has a thickness greater than a thickness of a base of the cylindrical body;

a first groove and tongue structure formed in an axial end surface of the side wall of the cylindrical body, which surrounds a cavity formed in the cylindrical body, the cavity extending through the center axis of the cylindrical body and comprising an insert loaded into the cavity, wherein the cavity is adapted to the shape of the insert;

a second groove and tongue structure formed in a surface of the circular cover and fitting to the first groove and tongue structure, wherein the circular cover is attached to the cylindrical body using the first and second groove and tongue structures, wherein all parts of the circular cover located radially inside the groove and tongue structures have a thickness larger than a thickness of a part of the circular cover located radially outside of the groove and tongue structures, wherein said axial end surface has a height that is greater on a radially outer side of said first groove and tongue structure than on a radially inner side of said first groove and tongue structure, wherein said circular cover is correspondingly thinner on a radially outer side of said second groove and tongue structure than on a radially inner side of said second groove and tongue structure, wherein a thicker portion of said circular cover on the radially inner side of the second groove and tongue structure overlaps the axial end surface of said side wall, and wherein at least one of the first and second groove and tongue structures comprises a tongue inserted into a groove of the other of the first and second groove and tongue structures, wherein a dimension of the tongue is slightly larger than a dimension of the groove to obtain at least a medium fit.

2. The puck according to claim 1, wherein the cylindrical body and the circular cover are attached to each other by vulcanization.

3. The puck according to claim 1, wherein the cavity and the insert are configured to preserve a center of gravity of the puck when the cavity is loaded with the insert.

4. The puck according to claim 1, wherein diameters of the circular cover and of the cylindrical body correspond to a total diameter of the puck.

5. The puck according to claim 1, wherein the groove and tongue structures comprise at least a tongue comprising a rounded edge.

6. The puck according to claim 1, wherein a joint of the cylindrical body and the circular cover is arranged on a rough surface of the puck or on a border between a smooth surface and a rough or patterned surface of the puck.

7. The puck according to claim 1, wherein the groove and tongue structures comprise annular continuous groove and tongue structures.

8. The puck according to claim 1, wherein the outer shell is formed using the cylindrical body, the circular cover, and a second circular cover, and wherein a third groove and tongue structure is formed in a second axial end surface of the cylindrical body, which surrounds the cavity or another cavity formed in the cylindrical body; and wherein the second circular cover comprises a fourth groove and tongue structure formed in a surface of the second circular cover and fitting to the third groove and tongue structure;

wherein the second circular cover is attached to the cylindrical body using the third and fourth groove and tongue structures.

9. A method for manufacturing a puck comprising an outer shell formed using a cylindrical body and a circular cover, wherein a side wall of the cylindrical body has a thickness greater than a thickness of a base of the cylindrical body, wherein the method comprises:

providing the cylindrical body with a first groove and tongue structure on an axial end surface of the side wall of the cylindrical body, which surrounds a cavity formed in the cylindrical body, the cavity extending through the center axis of the cylindrical body, providing the circular cover with a second groove and tongue structure on a surface of the circular cover and fitting to the first groove and tongue structure, attaching to each other the cylindrical body and the circular cover using the first and second groove and tongue structures, wherein all parts of the circular cover located radially inside the groove and tongue structures have a thickness larger than a thickness of a part of the circular cover located radially outside of the groove and tongue structures, wherein said axial end surface has a height that is greater on a radially outer side of said first groove and tongue structure than on a radially inner side of said first groove and tongue structure, wherein said circular cover is correspondingly thinner on a radially outer side of said second groove and tongue structure than on a radially inner side of said second groove and tongue structure, wherein a thicker portion of said circular cover on the radially inner side of the second groove and tongue structure overlaps the axial end surface of said side wall, wherein at least one of the first and second groove and tongue structures comprises a tongue inserted into a groove of the other of the first and second groove and tongue structures, wherein a dimension of the tongue is slightly larger than a dimension of the groove to obtain at least a medium fit, and putting an insert inside the cavity of the cylindrical body prior to attaching the cylindrical body and the circular cover to each other, wherein the cavity is adapted to the shape of the insert.

10. The method for manufacturing a puck according to claim 9, wherein the method comprises attaching the cylindrical body and the circular cover by vulcanization.

11. The method for manufacturing a puck according to claim 9, wherein providing the cylindrical body and the circular cover comprises molding the cylindrical body and the circular cover.

12. The method for manufacturing a puck according to claim 9, further comprising:

providing the cylindrical body with a third groove and tongue structure formed in a second axial end surface of the cylindrical body, which surrounds the cavity or another cavity formed in the cylindrical body;

providing a second circular cover comprising a fourth groove and tongue structure formed in a surface thereof and fitting to the third groove and tongue structure; and attaching to each other the cylindrical body and the second circular cover using the third and fourth groove and tongue structures.

* * * * *